US007114485B2

(12) United States Patent
Pien

(10) Patent No.: US 7,114,485 B2
(45) Date of Patent: Oct. 3, 2006

(54) OVER EXPANDED TWO-STROKE ENGINES

(76) Inventor: Pao C. Pien, Marbelle Club, 840 S. Collier Blvd., Marco Island, FL (US) 34145

( * ) Notice: Subject to any disclaimer, the term of this patent is extended or adjusted under 35 U.S.C. 154(b) by 0 days.

(21) Appl. No.: 11/048,188

(22) Filed: Feb. 1, 2005

(65) Prior Publication Data

US 2005/0155569 A1 Jul. 21, 2005

Related U.S. Application Data

(63) Continuation-in-part of application No. 10/758,493, filed on Jan. 15, 2004, now Pat. No. 6,848,416.

(51) Int. Cl.
*F02B 1/14* (2006.01)
*F02D 41/26* (2006.01)

(52) U.S. Cl. ..... 123/305; 123/559.1

(58) Field of Classification Search ..... 123/90.15, 123/316, 305, 299–300, 559.1, 561, 65 BA, 123/27 R; 60/598, 599, 620–624
See application file for complete search history.

(56) References Cited

U.S. PATENT DOCUMENTS

| | | | | | |
|---|---|---|---|---|---|
| 2,292,233 | A | * | 8/1942 | Lysholm | 123/559.1 |
| 2,820,339 | A | * | 1/1958 | Grieshaber et al. | 60/603 |
| 2,917,031 | A | | 12/1959 | Nestorovic | 123/299 |
| 3,093,959 | A | * | 6/1963 | Birmann | 60/605.1 |
| 3,125,076 | A | | 3/1964 | Mullaney | 123/305 |
| 4,050,420 | A | | 9/1977 | Cataldo | 123/260 |
| 4,280,468 | A | | 7/1981 | Millman | 123/546 |
| 4,520,765 | A | * | 6/1985 | Gerace | 123/27 R |
| 4,815,423 | A | | 3/1989 | Holmer | 123/90.6 |
| 5,117,788 | A | | 6/1992 | Blaser | 123/193.63 |
| 5,228,415 | A | * | 7/1993 | Williams | 123/51 R |
| 5,265,562 | A | * | 11/1993 | Kruse | 123/27 R |
| 5,311,739 | A | | 5/1994 | Clark | 60/39.6 |
| 5,341,771 | A | * | 8/1994 | Riley | 123/48 AA |
| 5,460,128 | A | * | 10/1995 | Kruse | 123/27 R |
| 5,566,650 | A | * | 10/1996 | Kruse | 123/27 R |
| 6,058,904 | A | * | 5/2000 | Kruse | 123/295 |
| 6,223,846 | B1 | * | 5/2001 | Schechter | 180/165 |
| 6,405,704 | B1 | | 6/2002 | Kruse | 123/295 |
| 6,457,309 | B1 | | 10/2002 | Firey | 60/517 |
| 6,481,206 | B1 | | 11/2002 | Pien | 60/620 |

(Continued)

FOREIGN PATENT DOCUMENTS

| | | |
|---|---|---|
| WO | WO 87/07325 | * 12/1987 |

*Primary Examiner*—Hai Huynh
(74) *Attorney, Agent, or Firm*—Whiteford, Taylor & Preston LLP; Jeffrey C. Maynard

(57) ABSTRACT

A method for combusting fuel in an engine involving decreasing a first volume of a homogeneous lean fuel/air charge to a second volume, in two stages, while increasing the pressure and temperature of that charge (a compression process having a chosen compression ratio), then increasing the pressure at constant volume while adding heat until a predetermined temperature is obtained, increasing the third volume of gas to a fourth volume, in two stages while decreasing the pressure at the predetermined temperature (an expansion process having a chosen expansion ratio much greater than the compression ratio), decreasing the pressure to atmospheric pressure while removing heat under constant volume, and finally decreasing the volume of gas to the first volume while removing heat under constant pressure to complete an over expanded, cycle. Also disclosed is an engine employing said over expanded, two-stroke HCCI cycle.

15 Claims, 3 Drawing Sheets

U.S. PATENT DOCUMENTS 6,848,416 B1 2/2005 Pien ..... 123/305
6,951,211 B1 * 10/2005 Bryant ..... 123/559.1
2003/0136356 A1 7/2003 Namkung ..... 123/27 R
2004/0244732 A1 * 12/2004 Kojic et al. ..... 123/21

* cited by examiner

OVER EXPANDED TWO-STROKE ENGINES

CROSS-REFERENCE TO RELATED APPLICATIONS

Related Application

This application is a continuation-in-part of U.S. patent application Ser. No. 10/758,493, entitled "Over Expanded Limited-Temperature Cycle Two-Stroke Engines", filed with the U.S. Patent and Trademark Office on Jan. 15, 2004 now U.S. Pat. No. 6,848,416 by the inventor herein, the specification of which is included herein by reference.

BACKGROUND OF THE INVENTION

1. Field of the Invention

The present invention relates to internal combustion engines and, more particularly, to a two-stroke, over expanded homogeneous charge compression ignition (HCCI) engine cycle designed to solve the major obstacles preventing the commercialization of HCCI engines, including controlling the timing of autoignition and operation over a wide range of load requirements. In addition to solving these problems, the cycle provides superior thermal and mechanical efficiency over existing four-stroke HCCI engines.

2. Background of the Prior Art

In the quest to develop a better internal combustion engine, satisfying emissions requirements is paramount. Potential gains in power and/or efficiency are immaterial, unless a new engine design is able to meet such requirements in a commercially feasible way. Of the three primary noxious emissions (NOx, CO and HC), developing ways to reduce nitrogen oxide (NOx) emissions is perhaps the most vexing. Moreover, under current engine operating cycles, potential solutions that address NOx emissions tend to exacerbate carbon monoxide (CO) and hydrocarbon (HC) emissions.

In traditional diesel engines, the high temperature of the early burned fuel-air mixture is the primary culprit in NOx formation. More specifically, combustion is initiated by injecting fuel into compressed air and the temperature rises due to the burning of the fuel. Importantly, the combustion of the fuel results in expansion of the burning gases thereby causing a rapid increase in pressure. This rapid increase in pressure following combustion causes an additional increase in temperature of the already burned gas. The cumulative increase in temperature that results from the burning of the fuel-air mixture, plus the additional increase caused by the post-burning compression, is referred to herein as the "post-combustion temperature." In a traditional diesel engine, the post-combustion temperature exceeds the threshold temperature at which unacceptable levels of NOx are formed.

Over the past several years, HCCI engines have held the promise of providing cleaner burning and more fuel efficient internal combustion engines. Characterized by the autoignition of a compressed lean homogenous charge, the entire compressed fuel/air mixture burns simultaneously avoiding further compression of already burned gases, which is the primary cause for the high combustion temperatures that cause the formation of NOx. Several obstacles, however, have thus far hindered the development of a commercially viable HCCI engine.

First, researchers have yet to develop a viable means for controlling the timing of autoignition of the compressed homogenous charge. Combustion is initiated by the compression of the homogenous charge to the required autoignition temperature. There is no commercially viable means, however, to precisely control the timing of autoignition because in a four-stroke HCCI cycle the chemical kinetics involved in the autoignition timing have thus far proved too complex to predict or control. In addition, even if the problem of controlling autoignition timing of the homogenous charge could be solved, conventional four-stroke HCCI engines can only sustain HCCI operation over a narrow range of load conditions.

SUMMARY OF THE INVENTION

The primary objective of this invention is to create an over expanded two-stroke HCCI engine operating cycle designed to allow ready control of autoignition timing. In addition, the new over expanded two-stroke HCCI cycle also features an additional heat addition process immediately following autoignition combustion of the homogenous charge, prolonging the combustion process in order to provide increased power when required by operating conditions.

The over expanded two-stroke HCCI cycle relies on the underlying two-stroke cycle of an over expanded two-stroke limited-temperature cycle. The underlying basic over expanded two-stroke cycle is comprised of a longer expansion stroke than compression stroke (resulting in a larger expansion process than compression process) and the utilization of the difference in stroke lengths for an exhaust/scavenging process. This basic over expanded two-stroke cycle provides the platform for the development of new over expanded two-stroke engines operating on a variety of different combustion modes. The instant application encompasses the application of the basic platform to an over expanded two-stroke HCCI engine cycle that solves the problem of the control of the timing of autoignition and provides a method for extending the operation of the HCCI engine over a broader range of loads.

With a larger expansion ratio of an expansion process than the compression ratio of a compression process, inherent in the over expanded two-stroke cycle is a difference in the length of the compression stroke and expansion stroke achieved by controlling the timing of the opening and closing of the intake and exhaust valves. The difference in stroke lengths allows the incorporation of a partial exhaust process. In turn, this partial exhaust process allows the elimination of the intake port required in conventional two-stroke engine configurations which intake port is replaced by conventional intake valves. The elimination of the intake port allows the over expanded two-stroke HCCI engine to be developed utilizing an existing supercharged four-stroke engine.

Traditionally, the combustion process of an internal combustion engine has been designed separate from the other components of the total thermodynamic processes. An advanced over expanded two-stroke HCCI engine has been created in which the combustion process takes place simultaneously with the first part of the expansion process (at the beginning of down stroke). The rate of combustion heat release is coordinated with piston movement to obtain constant volume (in theory), constant pressure, and/or constant temperature combustion.

The difference between the downward expansion stroke (longer) and upward compression stroke (shorter) is utilized to expel exhaust gas from the cylinder and the intake of a partially compressed fresh homogenous charge. A separate compressor is employed to partially compress the fresh homogenous charge facilitating a further shortening of the in-cylinder compression process. This unique over expanded two-stroke cycle makes possible a three-stage fuel injection process for (i) controlling autoignition timing, (ii) achieving a clean-burning combustion process, (iii) providing required power output over a wide range of operating conditions, and (iv) significantly increasing fuel economy.

The autoignition temperature of hydrocarbon fuel is between 900°–1000° K. On the other hand, the threshold temperature at which NOx forms is generally believed to be between 1800°–2100° K. These key temperature parameters provide the framework for the following three-stage fuel injection process:

Stage I: Fuel is injected under low-pressure into a separate air compressor to provide a partially compressed lean homogeneous charge upon intake to the engine cylinder. Once admitted to the cylinder, the partially compressed lean homogeneous charge is further compressed by the upward movement of the piston to reach a compression temperature of approximately 900° K (or other appropriate temperature selected to be just below the temperature at which autoignition would be triggered).

Stage II: A small amount of fuel is injected as a pilot injection just prior to the piston reaching top dead center ('TDC') so as to trigger autoignition when the piston reaches TDC. The purpose of this pilot injection is to increase the compressed mixture temperature by approximately 100° K, which increase is sufficient to trigger autoignition. The appropriate equivalence ratio is selected so that the combustion temperature reached after autoignition of the homogenous charge is approximately 2000° K (or other selected temperature that is sufficiently low to avoid the formation of NOx).

Stage III: Following autoignition combustion of the lean homogeneous charge (which combustion temperature is below the threshold temperature for the formation of NOx), a third injection of fuel is made in an amount necessary to achieve additional combustion at a constant temperature 2000° K (or other selected temperature) in order to generate additional power without producing NOx.

The key to controlling autoignition is the predictability of in-cylinder temperature of the compressed homogenous charge made possible by the over expanded two-stroke cycle. Specifically, under the new cycle, the crank angle from when the intake valve(s) is closed to TDC is less than 90-degrees. The homogeneous charge enters the cylinder upon intake at a predictable temperature. Because of the extremely short duration of the compression process together with the negligible rate for chemical kinetics (of the homogenous charge) at temperatures below 900° K, obtaining the required compression temperature value of 900° K can be accomplished solely by controlling the compression ratio by varying the timing of the closing of the intake valve(s).

A small pilot injection sufficient to increase the compressed mixture temperature by approximately 100° K is made just prior to the piston reaching TDC timed to trigger autoignition combustion at TDC. Lastly, for additional power output, the third stage of fuel injection occurs on the heels of the autoignition combustion (of the lean homogenous charge) to achieve additional combustion at a constant limiting temperature of 2000° K (or other selected value). Achieving constant temperature combustion requires a simultaneous large volume increase, which increase reduces thermal efficiency because of a reduced effective expansion ratio. This reduction, however, is offset by the increased engine output, which also increases engine power density and thus results in increased mechanical efficiency. Moreover, the reduction of thermal efficiency compensated for by the increase of mechanical efficiency greatly reduces the variation in brake efficiency at different levels of engine output as compared to traditional four-stroke engines.

Accordingly, it is an object of the invention to enable a two-stroke engine cycle that avoids the disadvantages of the prior art.

Another objective is to create a two-stroke engine operating on an improved engine cycle.

It is another object of the invention to provide a two-stroke engine that reduces NOx emissions.

It is a further object of the invention to provide a two-stroke engine having reduced CO and HC emissions.

In accordance with the above objects, the invention overcomes the limitations of existing internal combustion engines and provides a method and an engine for promoting homogeneous charge compression ignition.

To this end, one aspect of the present invention discloses a method for combusting fuel in an engine involving decreasing a first volume of gas to a second volume while increasing the pressure in a compressor, then continuing to decrease the second volume to a third volume while increasing the pressure and temperature of that volume of gas (a compression process having a chosen compression ratio), then increasing the pressure at a constant third volume equal to a fourth volume while adding heat to remain below a predetermined temperature, increasing the fourth volume of gas to a fifth volume while adding the amount of heat necessary to maintain the predetermined temperature, increasing the fifth volume to a sixth volume (an expansion process having a chosen expansion ratio selected to be much greater than the compression ratio), decreasing the pressure to atmospheric pressure while removing heat under constant volume, and finally, decreasing the volume of gas to the first volume while removing heat under constant pressure to complete an over expanded cycle. Another aspect of the invention encompasses an advanced two-stroke engine operating on the newly created over expanded cycle.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

The invention enabled herein provides a method and an engine for controlling the timing of autoignition timing of an HCCI engine and extending the range of loads that the engine can operate. The method achieves these goals by employing a three-stage sequential fuel injection (and heat release) process. Such three-stage fuel injection process is made possible by the underlying basic over expanded two-stroke engine cycle, which is further described in U.S. patent application Ser. No. 10/758,493, the description of which is incorporated herein by reference. However, instead of utilizing a combustion process designed to achieve low-temperature compression ignition combustion, the present invention utilizes a three-stage fuel injection process for achieving HCCI combustion and to prolong the combustion process.

Figure 1:
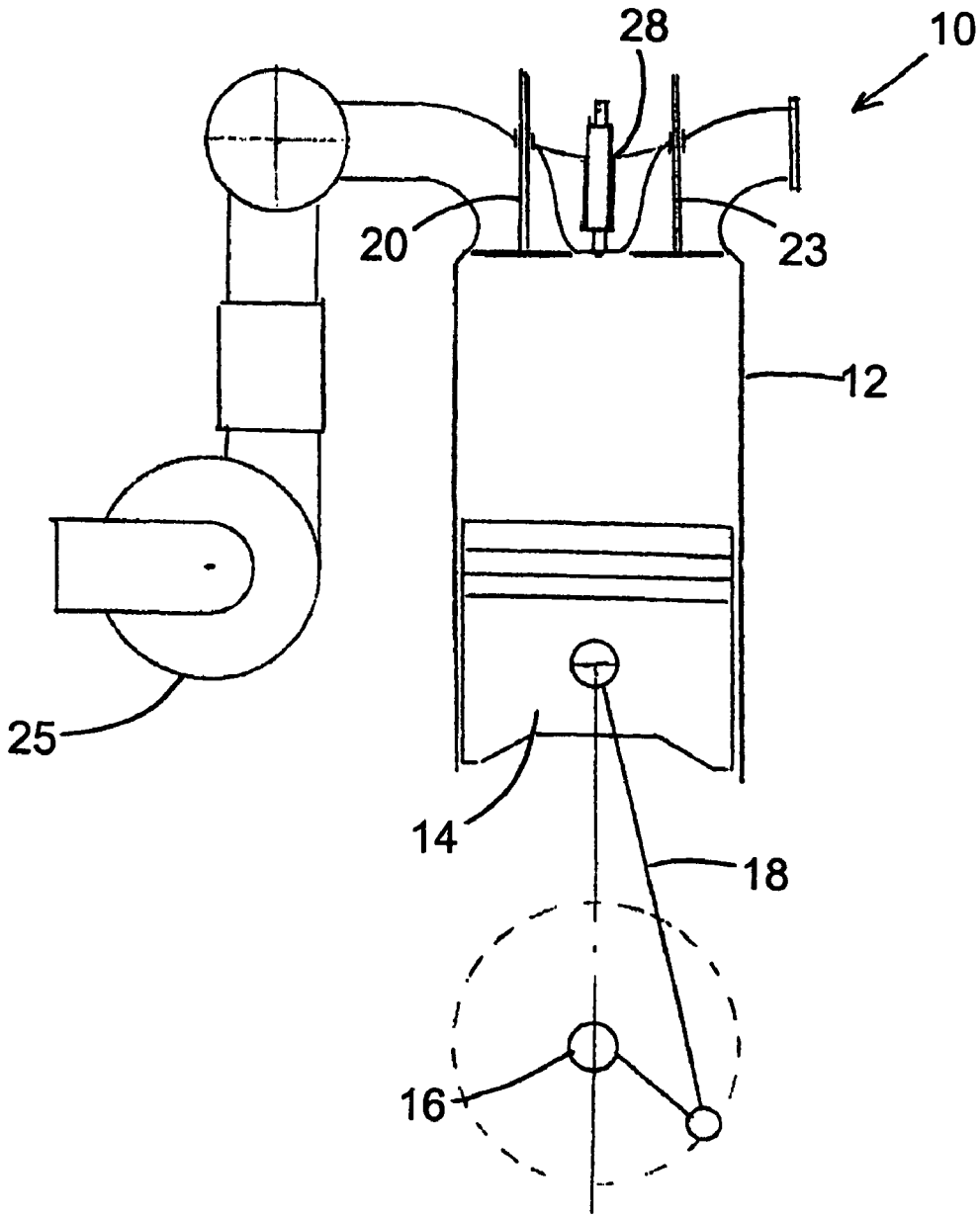
FIG. 1 shows a schematic view of an over expanded two-stroke engine according to the present invention.
Figure 2:
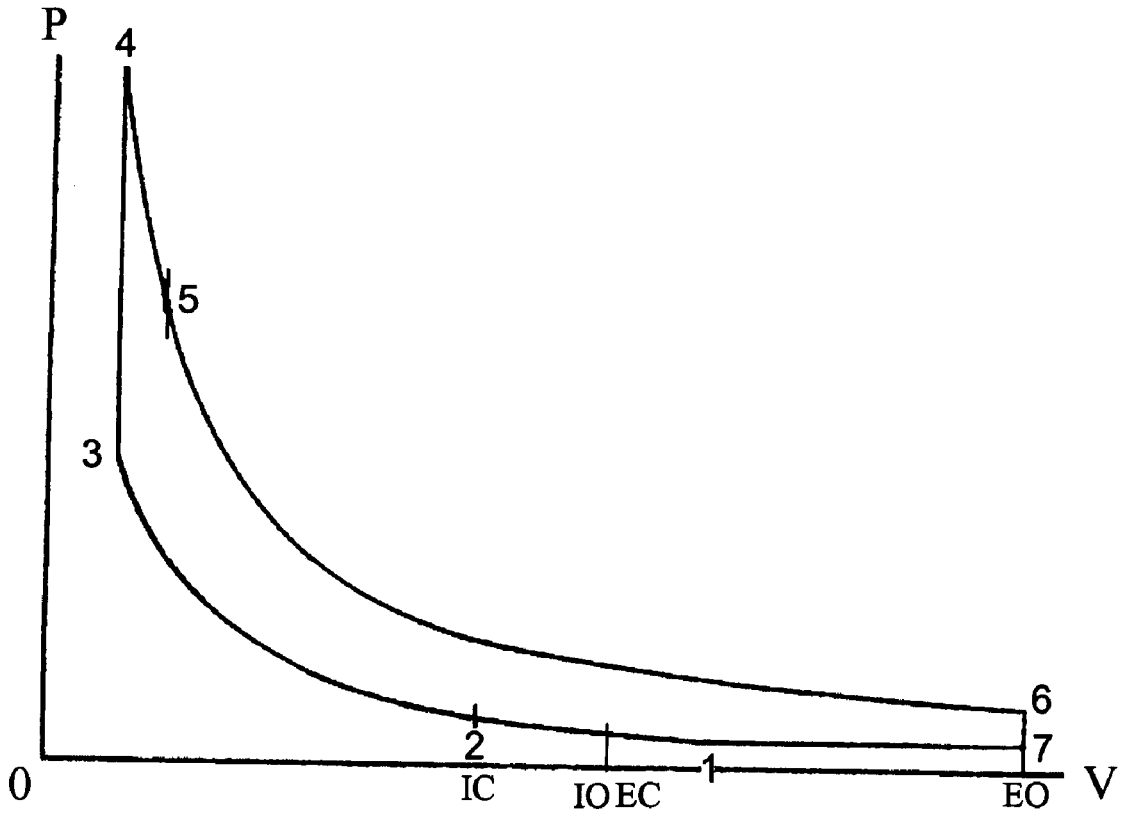
FIG. 2 illustrates a P-V diagram of an over expanded, HCCI cycle.

Referring now to the drawings, FIG. 1 shows a two-stroke engine, indicated generally as 10. Engine 10 comprises at least one cylinder 12 containing a piston 14 connected to a crankshaft 16 by means of a connector rod 18. At the top of cylinder 12, are an intake valve 20 and an exhaust valve 23. The intake valve 20 provides homogenous charge to cylinder 12 that comes from the mixing of air from the atmosphere and injected fuel by way of a compressor 25. A fuel injector 28 provides fuel to cylinder 12 at an appropriate time during the engine cycle. In FIG. 2, a P-V diagram of an over expanded, HCCI cycle is shown. The cycle starts at point 1 with air at ambient temperature and pressure. From point 1 to point 2, a first compression process takes place to reduce the volume of air to $V_2$ and increase the pressure to $P_2$. $P_2$ reflects the pressure of partially compressed homogeneous charge, produced by compressor 25 depicted in FIG. 1. A second compression process takes place from point 2 to point 3 by reducing the volume in cylinder 12. The process 1-2-3 is a two-stage compression process having a chosen compression ratio (with an appropriate cylinder clearance volume $V_3$). The desired compression ratio is obtained by selecting an appropriate value for volume $V_3$ relative to $V_1$. From point 3 to point 4, heat is added under constant volume, increasing the combustion pressure. The amount of heat added is limited to ensure that the temperature does not exceed the predetermined limiting temperature. From point 4 to point 5, more heat is added under the constant limiting temperature. From point 5 to point 6, an expansion process takes place having a chosen expansion ratio (by having sufficiently large total cylinder volume $V_6$ relative to the clearance volume $V_3$). From point 6 to point 7, a blow down process removes heat under constant volume. From point 7 to point 1, heat is removed under constant pressure to complete the cycle.

The compression process 1-2-3 has two parts. First, process 1-2 is performed in a separate air compressor 25 with the entrance of the partially compressed lean homogenous mixture to cylinder 12 occurring at a point between points 1 and 2 when the intake valve opens, indicated by IO in FIG. 2. The Stage I fuel injection takes place in a separate air compressor 25 to provide a partly compressed lean homogeneous charge to the intake manifold. The second part of the compression process 2-3 takes place in the engine cylinder 12 (by the upward movement of the piston 14) to reach a compression temperature $T_3$ of approximately 900° K (or just below the autoignition temperature of the compressed charge).

A variable timing intake valve 20 varies the closing timing at point 2 to control engine compression ratio and thus the compression temperature at the end of the second part of the compression process (from 2-3) to reach a temperature of 900° K (or other temperature just below the autoignition temperature). Since the lean homogeneous charge enters the cylinder 12 with a predictable temperature and because of the very short duration of the compression process 2-3 (for pre-combustion chemical kinetic interaction), the required compression temperature $T_3$ at point 3 can be easily obtained regardless of engine rpm and load by controlling the timing of the closing of the intake valve 20.

Before the piston reaches TDC, a Stage II pilot fuel injection takes place through fuel injector 28, which pilot injection provides a "boost" in compression temperature (increasing temperature by approximately 100° K) of the existing compressed mixture sufficient to trigger autoignition of the lean homogenous charge at TDC. The equivalence ratio is selected such that the autoignition combustion process 3-4 reaches (but does not exceed) a combustion temperature of 2000° K (or other temperature below the threshold temperature for the formation of NOx). Immediately after autoignition and combustion of the lean homogenous charge, the Stage III fuel injection takes place to begin constant temperature combustion process 4-5.

The ensuing expansion process extends beyond $V_1$ to reach $V_6$ as shown in FIG. 2. At point 6, the exhaust valve 23 opens (indicated by EO) to begin a blow down process 6-7. Approximately one-half of the exhaust gas escapes from the cylinder 12 during the blow down process 6-7. An exhaust process begins when the piston 14 reaches bottom dead center ('BDC') and begins its upward motion. The exhaust process ends when the exhaust valve 23 closes indicated by EC. The timing of the closing of the exhaust valve 23 is selected to trap the desired amount of exhaust gas within the cylinder 12 in order to lower the combustion temperature of the ensuing lean homogenous charge. The intake valve 20 opens simultaneously with the closing of the exhaust valve 23 to admit a partially compressed homogeneous charge from the separate compressor 25 into the cylinder 12, starting the next cycle.

Since $V_3$ is equal to $V_4$, the P-V diagram of FIG. 2 shows that the volume expansion from point 4 to point 6 is much larger than the volume compression from point 1 to point 3. The availability of a portion of the compression stroke for a partial exhaust process and intake process demonstrates that the over expanded HCCI cycle can be operated on the two-stroke engine 10 shown in FIG. 1 with the first stage compression process 1-2 being done by a separate compressor 25.

Figure 3:
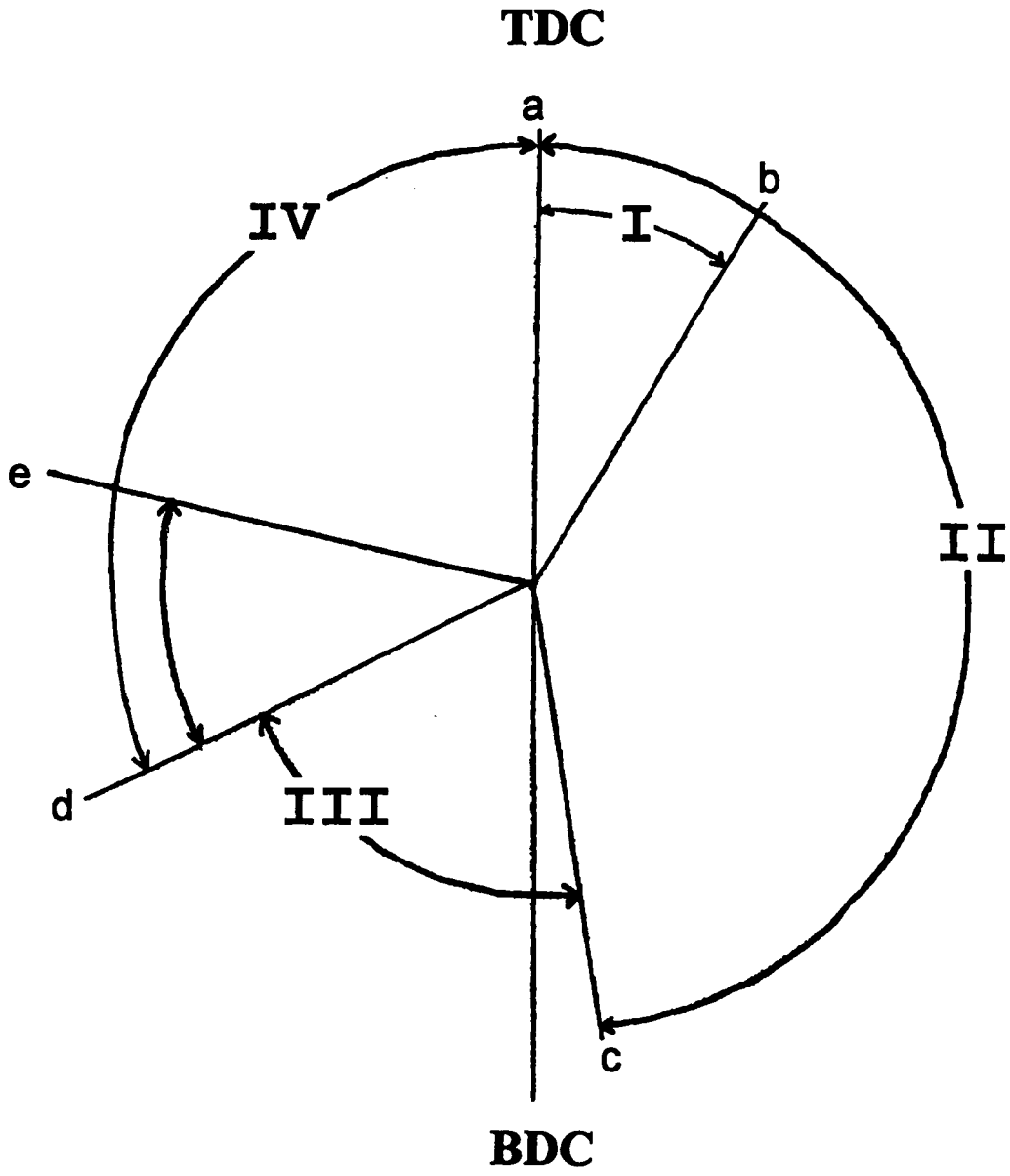
FIG. 3 shows the two-stroke engine intake and exhaust valves open and closing timings and corresponding cycle processes.

The opening and closing timing of the intake valve 20 and exhaust valve 23 is shown in FIG. 3. At point "a" top dead center ('TDC'), both fuel injection/combustion and expansion processes begin simultaneously. Fuel injection/combustion ends at point "b". The expansion process continues to point "c" where exhaust valve 23 opens slightly before the piston 14 reaches bottom dead center ('BDC') to begin a blow down process (6-7 in FIG. 2). An exhaust process begins at point "c" and ends at point "d" where the exhaust valve 23 closes. The intake valve 20 opens at point "d", simultaneously with the closing of the exhaust valve 23. Intake valve 20 closes at point "e". When the intake valve 20 opens at point "d", lean homogeneous charge up to pressure $P_2$ is forced into the cylinder 12. When the intake valve 20 closes at point "e", the second part of the compression process (2-3 in FIG. 2) takes place. Four processes, namely, combustion (a-b), expansion (a-b-c), exhaust (c-d), and compression (d-e-a), indicated by I, II, III, and IV in FIG. 3 are the cycle events of the over expanded two-stroke engine 10.

Air compressor 25 sucks atmosphere air in and provides partially compressed homogeneous charge to the engine intake manifold. Starting from BDC to when the engine piston 14 has covered a portion of its upward (compression) stroke, the exhaust valve 23 closes and simultaneously the intake valve 20 opens at point "d" to admit partially compressed homogenous charge (the first part of the compression process) to begin the second part of the compression process. Immediately prior to when the piston reaches TDC, a pilot fuel injection takes place to trigger autoignition at TDC to reach a predetermined limiting temperature at constant volume. An expansion process begins simultaneously with the combustion process at TDC and continues until the exhaust valve 23 opens just before the piston reaches BDC to begin a blow down process and the ensuing exhaust stroke follows. The cycle repeats when the exhaust valve closes again and the intake valve opens. As shown in FIGS. 2 and 3, the expansion stroke is much longer than the compression stroke. The ratio between the expansion stroke and compression stroke lengths is chosen as a compromise between higher cycle thermal efficiency and lower engine frictional losses.

During the blow-down process, cylinder pressure drops to atmospheric pressure allowing approximately one-half of the exhaust gas to exit through the opened exhaust valve. During the exhaust process, a large portion of the remaining exhaust gas exits through the open exhaust valve. Any remaining exhaust gas within the cylinder (following the blow-down and exhaust processes) becomes recycled in the next cycle. Therefore, the two-stroke engine operating on an over expanded cycle, as described herein, can achieve high power density and fuel efficiency with minimal emissions. Furthermore, such two-stroke engine can achieve high cycle efficiency without high maximum cycle pressure and temperature. This, in turn, allows for reduced engine emissions and engine friction and heat losses.

The following are examples of air cycle analysis of an over expanded two-stroke HCCI cycle for assessing the performance of the over expanded two-stroke HCCI engine disclosed herein. For purposes of undertaking such analysis, the analyses utilize a formula based on heat energy (instead of mechanical work balance), in which the thermal efficiency is computed in terms of heat addition $Q^+$ and heat removal $Q^-$, utilizing only the two basic equations; PV=RT and $T_2/T_1=(V_1/V_2)^{k-1}$.

Case 1: $Q_{4-5}=0$, Corresponding to an Over Expanded Otto Cycle

Starting at point 1 of FIG. 2, $V_1=15.6$, $P_1=14.7$, and $T_1=311$ K. At point 3, the end of compression process 2-3, assuming $V_3=1.095$ (for an overall compression ratio of 14.25), $P_3=606.2$, $T_3=900$ K. At point 4, $T_4=2000$ K, $Q_{3-4}=0.308(2000-900)=338.9$ Btu/lbm, $P_4=1347$, and $V_4=V_3=1.095$. Assuming no third stage fuel injection and $V_6=19.5$, the expansion ratio is 19.5/1.095=17.8. At point 6, $P_6=23.9$ and $T_6=632.2$. At point 7, $V_7=19.5$, $P_7=14.7$, and $T_7=632.2(14.7/23.9)=388.9$. $Q_{6-7}=0.308(388.9-632.2)=-74.9$ Btu/lbm and $Q_{7-1}=0.432(388.9-311)=-33.6$. Total $Q^-=-108.5$ and Efficiency=(338.9−108.5)/338.9=68%, $\phi=338.9/1200=0.282$ Case 2: $Q_{4-5}=Q_{3-4}/3=113.0$ Btu/lbm Without constant temperature combustion process 4-5 with $Q_{4-5}=113$, burned mixture temperature would drop to T' with T'=2000−113.0/0.308=1633 K and the volume reaches $V_5$ with $V_5=V_4(2000/1633)^{2.5}=1.82$. The constant temperature combustion process 4-5 brings back the mixture temperature at point 5 to 2000 K and pressure to $P_5$ with $P_5=P_4V_4/V_5=810.4$. The expansion ratio of expansion process 5-6 is equal to 19.5/1.82=10.7. At point 6, $V_6=19.5$, $P_6=29.3$, and $T_6=775$. At point 7, $T_7=(14.7/29.3)T_6=388.7$, $Q_{6-7}=0.308(388.7-775)=-119$. $Q_{7-1}=0.432(311-388.7)=-33.6$. Total $Q^-=152.6$ and $Q^+=451.9$. Efficiency=(451.9−152.6)/451.9=66.2%, $\phi=451.9/1200=0.376$.

Without constant temperature combustion process 4-5 with $Q_{4-5}=169.5$, burned mixture temperature would drop to T' with T'=2000−169.5/0.308=1450.0 K. The volume reaches $V_5$ with $V_5=V_4(2000/1449.7)^{2.5}=2.45$. The constant temperature combustion process 4-5 brings back the mixture temperature at point 5 to 2000 K, and $P_5=P_4V_4/V_5=602.5$. The expansion ratio of expansion process 5-6 is equal to 19.5/2.45=7.96. At point 6, $V_6=19.5$, $P_6=33.0$, and $T_6=872$. At point 7, $T_7=(14.7/33.0)T_6=388.7$, $Q_{6-7}=0.308(388.7-872)=-149$. $Q_{7-1}=0.432(311-388.7)=33.6$. Total $Q^-=182.5$ and $Q^+=508.5$. Efficiency=(508.5−182.5/508.5=64.1%, $\phi=2\times505/1200=0.424$.

For constant temperature combustion, T'=2000−338.9/0.308=900 K. At point 5, $V_5=V_4(2000/900)^{2.5}=8.06$, $P_5=P_4V_4/V_5=183.0$, and $T_5=2000$ K. The expansion ratio of expansion process 5-6 is equal to 19.5/8.06=2.42. At point 6, $V_6=19.5$, $P_6=53.1$, and $T_6=1404$. At point 7, $T_7=(14.7/53.1)T_6=388.7$, $Q_{6-7}=0.308(388.7-1404)=-312.7$. $Q_{7-1}=0.432(311-388.7)=33.6$. Total $Q^-=343.3$ and $Q^+=677.8$. Efficiency=(677.8−343.3)/677.8=49%, $\phi=766.8/1200=0.565$.

The results of these four cases demonstrate that the new over expanded cycle two-stroke HCCI engine can generate a large range of power output with high fuel efficiency without producing NOx and PM emissions. Because the specific engine weight (engine weight divided by engine power output) is inversely proportional to power density, an over expanded two-stroke HCCI cycle engine is much lighter than a four-stroke gasoline engine having the same power output.

If the Stage III fuel injection is eliminated, Case 1 is essentially an over expanded Otto cycle two-stroke HCCI engine. Compared with a four-stroke gasoline engine having a thermal efficiency of 58% (assuming a compression ratio of 8.5), the thermal efficiency ratio equals 68/58=1.17. The piston displacement ratio equals (19.5−1.095)/(15.6−1.095) =1.27. The power density (power output divided by piston displacement volume) ratio equals 2×1.17/1.27=1.84, Thus, with a power density ratio of 1.84, an engine operating on the new two-stroke HCCI cycle could achieve the same power output of a four-stroke gasoline engine with only 54% of the displacement volume, or a 46% downsizing.

With lower combustion pressure and temperature, the useful life of an engine can be greatly prolonged. Such low combustion temperature greatly reduces engine heat losses, which leads to further reduction of specific fuel consumption. The new engine described herein has many of the features of a perfect engine with application for air, land, and sea transportation uses as well as for stationary electricity generation power plants. Significantly, the new engine can be immediately built with available technologies and engine parts.

The above analysis is for illustration only. There are many items to be chosen, such as the predetermined limiting temperature, the pressure of partially compressed homogeneous charge, the compression ratio, and the expansion ratio. The optimum combination of these items is a compromise among fuel efficiency, engine emissions, and power density.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is my intention to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. An over expanded, two-stroke HCCI cycle for operating an HCCI engine comprising:

a compression process 1-2-3, said compression process 1-2-3 further comprising:

a first compression process 1-2 carried out via an external compressor; and a second compression process 2-3 carried out by changing the volume of a cylinder of said engine;

a multi-stage fuel injection process 1-2-3-4-5, said fuel injection process further comprising:

a first stage fuel injection taking place during said first compression process 1-2, which enters the cylinder via an intake manifold as a homogeneous charge;

a second stage fuel injection taking place towards the end of said second compression process 2-3; and a third stage fuel injection taking place at the start of an expansion process 4-5;

a heat addition process 3-4-5, said heat addition process 3-4-5 further comprising:

a first heat addition process 3-4 carried out via said second stage fuel injection triggering autoignition of the compressed homogenous charge;

a second heat addition via combustion of the homogeneous charge; and a third heat addition process 4-5 carried out via injection and combustion of said fuel in said cylinder while maintaining a constant, limiting temperature;

an adiabatic expansion process 5-6;

a heat removal process 6-7-1, said heat removal process 6-7-1 further comprising:

a first heat removal process 6-7 under a constant volume; and a second heat removal process 7-1 under constant pressure;

wherein said compression process, said heat addition process, said adiabatic expansion process, and said heat removal process combine to form an over expanded, HCCI cycle 1-2-3-4-5-6-7-1.

2. The over expanded, HCCI cycle of claim 1, wherein the change of volume associated with the compression process 1-2-3 is less than the change of volume associated with the heat addition and adiabatic expansion processes 3-4-5-6.

3. A method for combusting fuel in an engine comprising:

decreasing a first volume of a lean homogenous charge to a second volume via an external compressor;

further decreasing the second volume to a third volume while increasing a pressure and a temperature thereof;

adding a first amount of heat via injection;

adding a second amount of heat via combustion of fuel in a cylinder of said engine until a predetermined temperature is attained increasing pressure and temperature thereof at constant volume via autoignition combustion of the compressed homogeneous charge;

increasing the third volume to a fourth volume while adding a third amount of heat via injection and combustion of fuel in said cylinder while decreasing the pressure thereof and while maintaining the temperature constant at the predetermined temperature;

increasing the fourth volume to a fifth volume while decreasing the pressure and temperature thereof;

decreasing the pressure to atmospheric pressure while removing heat at a constant volume; and decreasing the fifth volume to the first volume while removing heat under constant pressure.

4. The method of claim 3, wherein the equivalence ratio of the homogenous charge ensures that the post-combustion temperature will not exceed the threshold temperature at which NOx formation occurs.

5. The method of claim 3, wherein the step of increasing the fourth volume to a fifth volume is an adiabatic expansion.

6. An engine comprising:

an over expanded HCCI cycle engine comprising an external compressor providing partially compressed homogenous fuel/air mixture to said engine having a compression process with a predetermined compression ratio; and an expansion process with a predetermined expansion ratio, wherein the compression ratio is smaller than the expansion ratio and the difference in the expansion process and compression process is utilized to replace cylinder exhaust gas with a fresh charge;

said engine being adapted to combust fuel by:

injecting and mixing a first amount of fuel in said external compressor to create a homogeneous charge;

decreasing a first volume of said homogenous charge to a second volume via the external compressor;

decreasing the second volume of said homogeneous charge to a third volume while increasing a pressure and a temperature thereof;

adding a first amount of heat further by increasing a pressure and a temperature of said homogenous charge via injection of a pilot amount of fuel;

adding a second amount of heat at constant third volume via autoignition combustion of the compressed homogenous charge, which second amount of heat is selected to reach a predetermined temperature;

increasing the third volume to a fourth volume by adding a third amount of heat via injection and combustion of fuel in said cylinder while maintaining the temperature constant at the predetermined temperature;

increasing the fourth volume to a fifth volume while decreasing the pressure and temperature thereof;

decreasing the pressure to atmospheric pressure while removing heat at a constant volume; and decreasing the sixth volume to the first volume while removing heat under constant pressure.

7. The engine of claim 6, wherein the change of volume associated with the compression process is less than the change of volume associated with the expansion process.

8. The engine of claim 6, adapted to combust fuel by a limited-temperature combustion mode or by HCCI combustion mode or by other combustion modes.

9. The engine of claim 6, wherein said engine is a two-stroke engine.

10. The engine of claim 6, wherein combustion temperature does not exceed a pre-determined temperature selected to be less than the threshold temperature at which NOx formation takes place.

11. The engine of claim 6, wherein the fourth volume is increased to the fifth volume by adiabatic expansion.

12. The engine of claim 6, said engine having a two-stroke construction comprising:

a first stroke enabling a combustion process at its beginning with an expansion process throughout its entire stroke; and a second stroke having more than one half of said second stroke allocated for exhaust processes, with the remaining portion of said stroke allocated for admitting partially compressed homogeneous charge to the cylinder and further compression of partially compressed homogenous charge provided by said external compressor.

13. The engine of claim 12, wherein said engine achieves an expansion process having a longer stroke than the stroke for said compression process.

14. The engine of claim 12, wherein said engine achieves the difference in stroke lengths for the expansion and compression processes by varying the timing of the intake and exhaust valves.

15. The engine of claim 12, said engine having a power stroke for each revolution of a crankshaft.

* * * * *